US006493908B2

(12) United States Patent
Thalheim

(10) Patent No.: US 6,493,908 B2
(45) Date of Patent: Dec. 17, 2002

(54) CLASP FOR A BRACELET

(75) Inventor: Jean-Francois Thalheim, Lignieres (CH)

(73) Assignee: Conseils et Manufactures VI.G SA, Neuchatel (CH)

( * ) Notice: Subject to any disclaimer, the term of this patent is extended or adjusted under 35 U.S.C. 154(b) by 0 days.

(21) Appl. No.: 09/931,900

(22) Filed: Aug. 20, 2001

(65) Prior Publication Data

US 2002/0023320 A1 Feb. 28, 2002

(30) Foreign Application Priority Data

Aug. 22, 2000 (EP) ..... 00117993

(51) Int. Cl.[7] ..... F16B 7/00; F16B 5/14
(52) U.S. Cl. ..... 24/265 WS; 24/265 B
(58) Field of Search ..... 24/265 WS, 265 EC, 24/265 BC, 685, 695, 705, 715, 610, 625; 59/87; 368/282; 224/175, 164; 63/3.1, 3

(56) References Cited

U.S. PATENT DOCUMENTS 4,217,681 A * 8/1980 Grohoski et al. ..... 24/265 WS
4,564,308 A 1/1986 Ikegami et al.
5,416,953 A 5/1995 Hui
5,483,505 A * 1/1996 Cartier ..... 224/164 X
5,699,590 A 12/1997 Erard et al.
5,870,803 A * 2/1999 Jorst ..... 24/265 WS
5,991,978 A * 11/1999 Nussbaum ..... 24/265 B
6,014,793 A * 1/2000 Howald ..... 24/265 B

FOREIGN PATENT DOCUMENTS

| | | |
|---|---|---|
| CH | 276496 | 7/1951 |
| CH | 689 931 A5 | 2/2000 |
| NL | 59700 | 7/1947 |

* cited by examiner

*Primary Examiner*—Robert J. Sandy
(74) *Attorney, Agent, or Firm*—Young & Thompson

(57) ABSTRACT

A clasp for a bracelet, which makes it possible to bring together and to fasten together the two ends of a bracelet in a closed position and to separate these two ends of the bracelet in an open position, includes two pairs of interchangeable linkage members for connecting the ends of the bracelet to the body of the clasp, one of the pairs of linkage members being designed for connection to the ends of a flexible strap and the other for connection to the ends of a band of rigid links. Each linkage member is connected hingedly to the body of the clasp by a locking part which can be operated without the use of a tool other than a ball-point pen.

8 Claims, 3 Drawing Sheets

CLASP FOR A BRACELET

BACKGROUND OF THE INVENTION

The object of the present invention is a clasp for a bracelet, a watch strap or a watch band.

DESCRIPTION OF THE RELATED ART

Clasps are already known which are of the type provided with two or three blades, as well as other types of clasps which make it possible to bring together and to fasten together the two ends of a bracelet in a closed position or to separate these two ends of the bracelet in an open position.

These known clasps suffer, in particular, the drawback that they require the use of special tools for fastening the ends of the bracelet to the corresponding parts of the clasp and, above all, that they cannot accommodate different types of bracelets, for example flexible straps or metallic bands, i. e. comprised of rigid metallic links which are hinged together, because the fastening of the end of a bracelet to a clasp differs depending on whether the bracelet is a flexible strap or a metallic band. Accordingly, the same clasp cannot be used for different types of bracelets.

SUMMARY OF THE INVENTION

The purpose of the present invention is to provide a clasp which can be affixed to the ends of a bracelet without any particular tool beyond a ball-point pen or other pointed object and, above all, which can be affixed at will to flexible straps or to bands comprised of hinged links, in other words to provide a universal clasp which can be mounted interchangeably and without any tool on bracelets of different types, made of leather, metal, etc.

The present invention is aimed at providing a clasp for a bracelet which makes it possible to bring together and fasten together the two ends of a bracelet in its closed position and to separate these two ends of the bracelet in its open position.

BRIEF DESCRIPTION OF THE DRAWINGS

The appended drawing illustrates schematically and by way of example an embodiment of the clasp for a bracelet, according to the invention.

DESCRIPTION OF THE PREFERRED EMBODIMENTS

Figure 1:
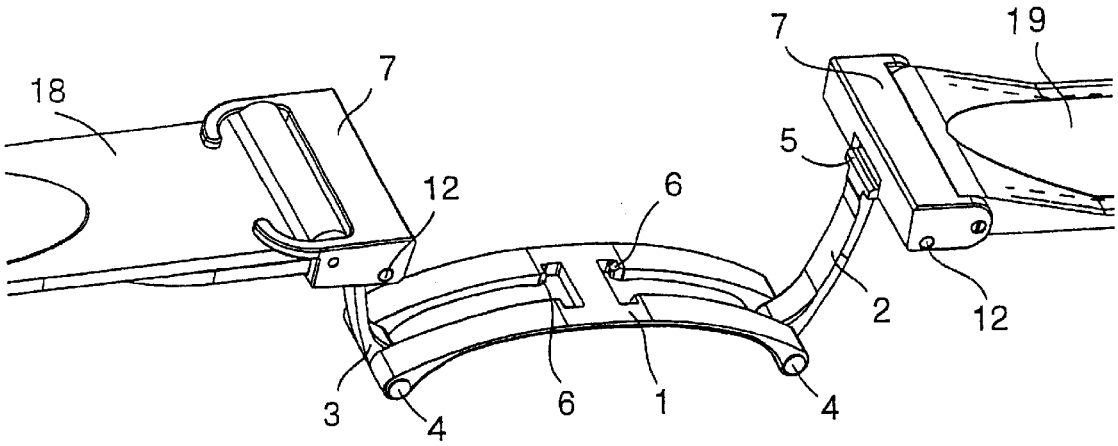
FIG. 1 is a perspective view from above of the clasp in its open position while remaining connected to the ends of a flexible strap.
Figure 2:
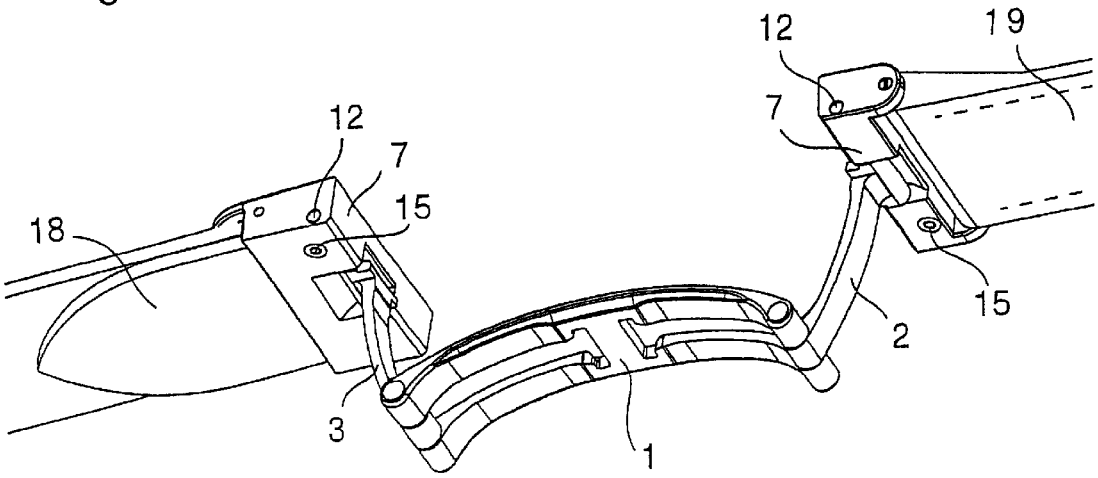
FIG. 2 is a perspective view from beneath of the clasp illustrated in FIG. 1.
Figure 3:
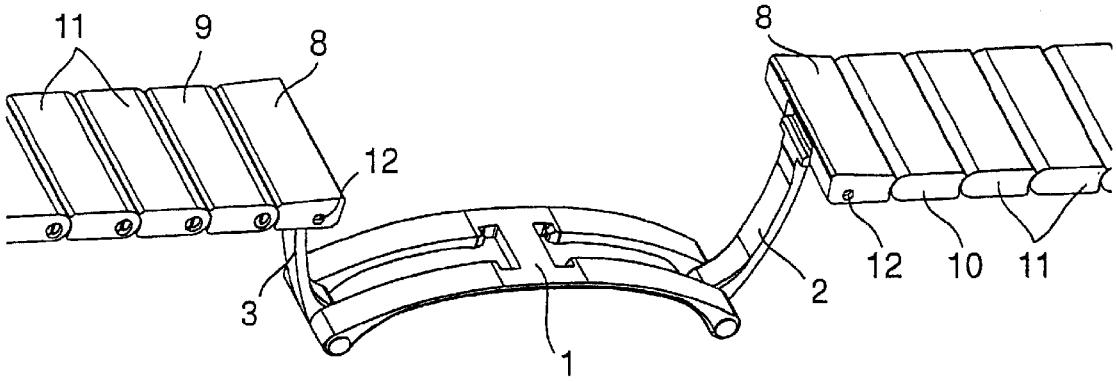
FIG. 3 is s perspective view from above of the clasp in its open position while remaining connected to the ends of a metal band comprised of hinged links.
Figure 4:
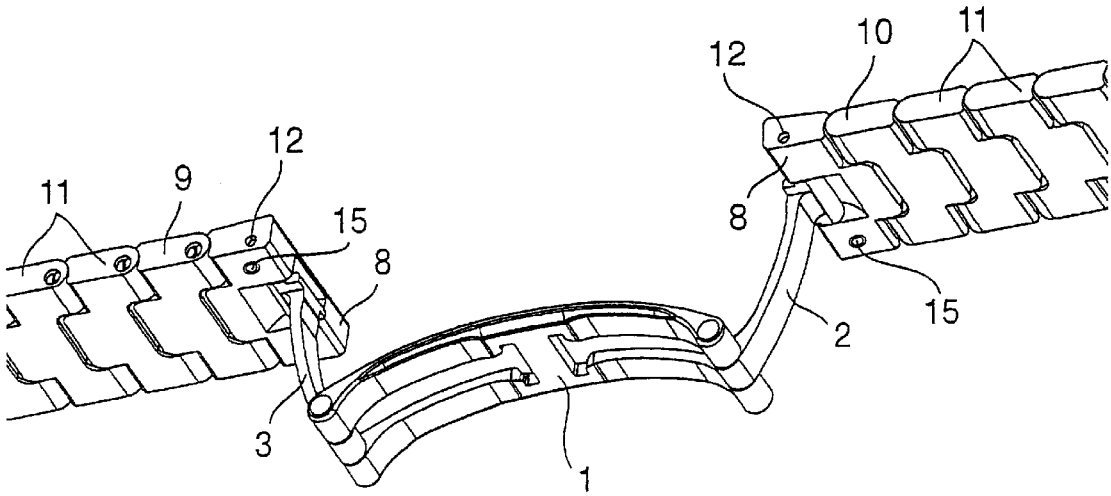
FIG. 4 is a perspective view from beneath of the clasp illustrated in FIG. 3.

The clasp according to the invention is designed for being interchangeably mountable on a flexible strap (leather, rubber, plastic, etc.) as shown in FIGS. 1–2 and on a rigid bracelet or on a band comprised of rigid links hinged together (metallic band, etc.) as shown in FIGS. 3–4.

The clasp illustrated by way of example is a clasp comprised of three folding lo parts, namely a central branch 1 hingedly connected at each end thereof to one end of a blade 2, 3 which can be folded by rotation around hinge pins 4 located in the same plane as the central branch. These blades 2, 3 carry at their ends which are not connected to the central branch 1, structures 5 which are designed for becoming engaged with matching structures 6 provided at the centre of the central branch 1, in order to retain by snapping these blades 2, 3, when folded over the central branch 1 in the closed position of the clasp.

The novel characteristic feature of this clasp lies in the use of interchangeable linkage members 7, 8 which can be fastened hingedly to the free ends of the blades 2, 3 through a locking means which can be actuated without the use of a tool other than, e.g. by a ball-point pen.

The linkage members 7 are constructed in such a manner that they may receive each one an end 18, 19 of a flexible strap, these ends being adjusted in their length and fastened to the linkage members 7 in a manner known per se, either by pulling back the ends of the bracelet around an axis, or by means of a tang or of a clip, etc.

The linkage members 8 can readily be fastened to the blades 2, 3 of the clasp, instead of the linkage member 7, by the locking means, and they are constructed in such a manner that they can be fastened hingedly to the end links 9, 10 of a band 11 by means of an axis or of a hinge pin. The length of the band is adjusted in a conventional manner.

Figure 5:
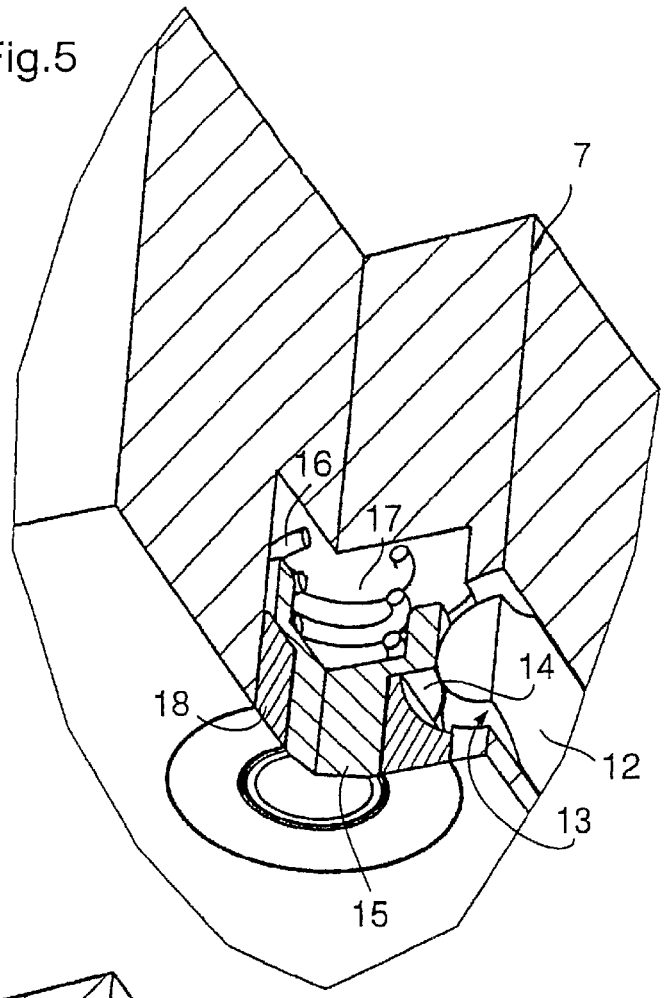
FIG. 5 is an enlarged partly cross-sectional view of an interchangeable end linkage member provided with a locking device in its hold position.

The rapid fastening of the linkage members 7 and 8 to the ends of the blades 2 and 3 of the clasp is achieved by means of hinge pins 12 which extend transversally through said linkage members 7, 8 and through the free ends of the blades 2, 3 and which act both as hinges and as connectors. Each hinge pin 12 has an annular groove 13 into which penetrates a locking device 14 to hold the linkage member coupled with the clasp (FIG. 5). Each locking device 14 is integral with a pusher 15 urged by a spring 16. This spring 16 and this pusher 15 are retained in a blind bore 17 provided on the lower face of each linkage members 7, 8 by means of an insert force-fitted or screwed into said blind bore 17.

Figure 6:
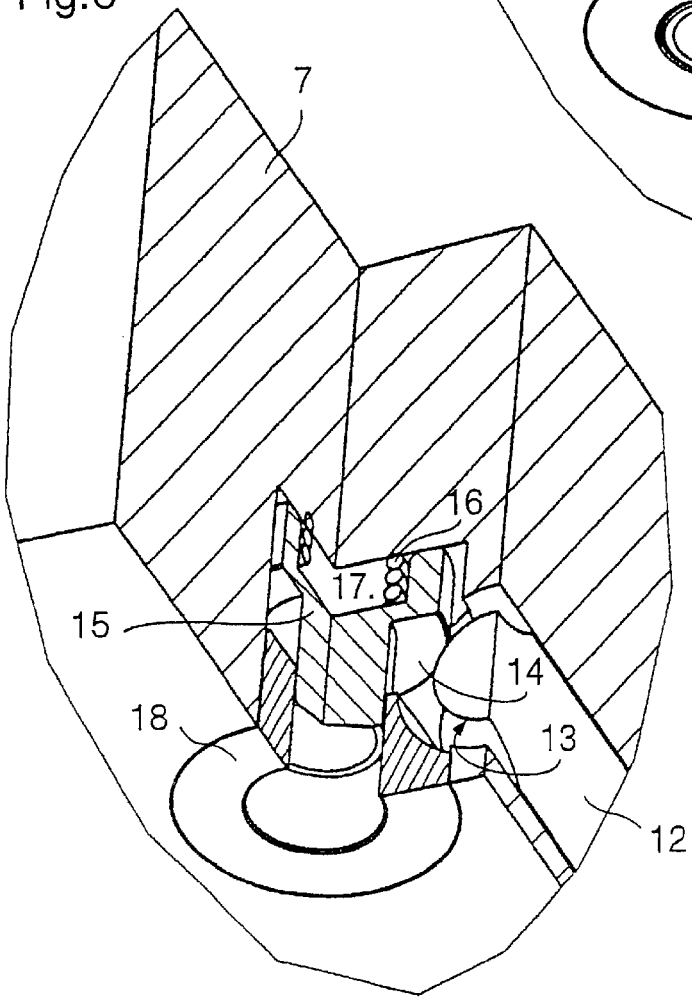
FIG. 6 is a view similar to that of FIG. 5, with the locking device in its release position.

To disassemble the linkage member 7, 8 from the clasp when, for example changing the bracelet, the user only needs to press the pusher 18 by means of a ball-point pen and to remove the hinge pin 12 (FIG. 6).

Accordingly, the clasp has a base structure comprised of the central branch 1 and of two lateral blades 2, 3 which can be unfolded and of two pairs of interchangeable linkage members 7, 8 which can be mounted hingedly on the base structure by the locking means described and illustrated in relation with FIGS. 5 and 6.

Each one of the pairs of linkage members 7 and 8 is specially constructed for receiving either a flexible strap or a band comprised of rigid links hinged together.

This clasp is extremely simple to use, both after having been sold and before, without being altered through its handling. The user only needs to use a pointed object such as a ball-point pen to change the bracelet instantaneously by depressing the pusher 15 and as many times as he/she wishes, without any complicated operation or tool.

This makes it possible to use only one clasp whatever the type or the material from which the bracelet is made and whether it is rigid or flexible, made of metal, leather, rubber, plastic or any other material.

The length adjustment of the flexible strap is simple for the user and identical whatever the material from which the flexible strap is made.

With this clasp, the user no longer needs the services of a specialist for changing his/her bracelet. No special tool is needed, a simple ball-point pen or pencil, for example, is sufficient for releasing the clasp from the bracelet.

Quite obviously, in alternate versions of the clasp, the same need not be of the foldable type and in fact, the two coupled parts of the clasp only need to be connected to the ends of a bracelet via the interchangeable linkage members 7, 8.

What is claimed is:

1. A bracelet clasp system enabling a wearer to change from a flexible bracelet to a rigid link bracelet, comprising:

a foldable clasp comprising a central branch and two blades, each blade foldably attached to an end of the central branch;

two pairs of linkage members removably connectable to free ends of the two blades one pair of linkage members at a time, a first pair of the two pair of linkage members for connection to a flexible bracelet and a second pair of the two pair of linkage members for connection to a rigid link bracelet; and a locking mechanism located within each linkage member, the locking mechanisms removably connecting the linkage members to the free ends of the blades, depression of an element of the locking mechanisms releasing the linkage members from the free ends of the blades.

2. The bracelet clasp system of claim 1, wherein each locking mechanism comprises:

a hinge pin extending transversally through the linkage member and the free end of the blade;

a pusher housed inside a blind bore of the linkage member;

a locking device integral with the pusher, the hinge pin having a circular groove co-operating in a locked position with the locking device and subject to an action of a spring acting on the pusher.

3. The bracelet clasp system of claim 2, wherein depression of the pusher releases the linkage member from the free end of the blade.

4. A bracelet clasp, comprising:

a foldable clasp central branch;

two blades, each blade foldably attached to an end of the central branch;

a pair of linkage members removably connectable to free ends of the two blades, the linkage members for connection to a bracelet; and a locking mechanism located within each linkage member, the locking mechanisms removably connecting the linkage members to the free ends of the blades, depression of a pusher element of the locking mechanisms releasing the linkage members from the free ends of the blades.

5. The bracelet clasp system of claim 4, wherein each locking mechanism comprises:

a hinge pin extending transversally through the linkage member and the free end of the blade, the pusher element housed inside a blind bore of the linkage member;

a locking device integral with the pusher, the hinge pin co-operating in a locked position with the locking device and subject to an action of a spring acting on the pusher, wherein depression of the pusher against the spring releases the linkage member from the free end of the blade.

6. A bracelet clasp system interchangeably mountable on a flexible bracelet and a rigid link bracelet, comprising:

a clasp comprising a central branch hingedly connected at each end thereof to one end of a blade;

two pairs of interchangeable linkage members removably fastened hingedly to free ends of the two blades one pair of linkage members at a time, a first pair of the two pair of linkage members for connection to a flexible bracelet and a second pair of the two pair of linkage members for connection to a rigid link bracelet; and a locking mechanism located within each linkage member, the locking mechanisms removably connecting the linkage members to the free ends of the blades, the locking member being actuated by depression of a pointed object for releasing the linkage members from the free ends of the blades.

7. The bracelet clasp system of claim 6, wherein each locking mechanism comprises a pusher, depression of the pusher releasing the linkage member from the free end of the blade.

8. The bracelet clasp system of claim 6, wherein the two pairs of interchangeable linkage members are further detachably mountable on a bracelet end.

* * * * *